US006032423A

United States Patent [19]

Takemura et al.

[11] Patent Number: 6,032,423

[45] Date of Patent: Mar. 7, 2000

[54] CURTAIN WALL HAVING MULLION STRUCTURE

[75] Inventors: Masami Takemura; Yoshiaki Tanari, both of Toyama, Japan

[73] Assignee: YKK Architectural Products Inc., Tokyo, Japan

[21] Appl. No.: 09/027,728

[22] Filed: Feb. 23, 1998

[30] Foreign Application Priority Data

Feb. 26, 1997 [JP] Japan ..... 9-041835

[51] Int. Cl.[7] ..... E04H 1/00

[52] U.S. Cl. ..... 52/235; 52/204.5; 52/213; 52/762; 52/764

[58] Field of Search ..... 52/204.1, 213, 52/204.5, 762, 764, 235

[56] References Cited

U.S. PATENT DOCUMENTS

| | | | |
|---|---|---|---|
| 2,963,126 | 12/1960 | Cudini | 52/235 |
| 3,052,330 | 9/1962 | Hammitt et al. | 52/235 |
| 3,081,849 | 3/1963 | Hubbard | 52/235 |
| 3,121,482 | 2/1964 | Cobb et al. | 52/235 |
| 3,235,039 | 2/1966 | O'Donnell | 52/235 |
| 3,266,210 | 8/1966 | Grossman | 52/235 |
| 3,443,346 | 5/1969 | Eggert, Jr. | 52/204.1 |
| 3,720,025 | 3/1973 | Eichman | 52/235 |
| 3,736,717 | 6/1973 | Farley | 52/235 |
| 3,766,698 | 10/1973 | Dallen | 52/235 |
| 4,055,923 | 11/1977 | Biebuyck | 52/235 |
| 4,207,717 | 6/1980 | Hubbard | 52/235 |
| 4,689,933 | 9/1987 | Biro | 52/204.5 |
| 4,873,805 | 10/1989 | Ting | 52/235 |
| 5,018,326 | 5/1991 | Reynolds | 52/235 |
| 5,063,718 | 11/1991 | Nonis | 52/235 |
| 5,065,557 | 11/1991 | Laplante | 52/235 |
| 5,069,014 | 12/1991 | Kubbutat | 52/235 |
| 5,435,106 | 7/1995 | Garries et al. | 52/204.5 |
| 5,845,440 | 12/1998 | Matsuyama et al. | 52/235 |

FOREIGN PATENT DOCUMENTS

| | | | |
|---|---|---|---|
| 2-33536 | 9/1990 | Japan . | |
| 2133449 | 1/1983 | United Kingdom | 52/235 |
| 2143558 | 2/1985 | United Kingdom | 52/235 |

*Primary Examiner*—Carl D. Friedman
*Assistant Examiner*—Dennis L. Dorsey
*Attorney, Agent, or Firm*—Finnegan, Henderson, Farabow, Garrett & Dunner, L.L.P.

[57] ABSTRACT

A curtain wall having a mullion structure comprises bilateral mullions, a sash unit to be mounted to the mullions, the sash unit comprising a sash unit frame and a sash mounted to the sash unit frame, supporting members fixed to the mullions for supporting the sash unit frame, and a fixing member disposed for fixing one of bilateral side portions of the sash unit frame to one of the mullions. The mullions are provided with recessed grooves, respectively, opened to a width direction of the sash in the mounted state, and the sash unit frame has bilateral side portions to be fitted in the recessed grooves respectively by inserting both side portions of the sash unit frame one by one into corresponding recessed grooves of the mullions from an indoor side of the sash unit in a manner such that bilateral lower portions of the sash unit frame are rested on said supporting members, respectively, in a mounted state of the sash unit frame, and one of the side portions of the sash unit frame is then fixed to corresponding one of the mullions by means of the fixing member.

3 Claims, 5 Drawing Sheets

CURTAIN WALL HAVING MULLION STRUCTURE

BACKGROUND OF THE INVENTION

The present invention relates to a mullion-type curtain wall or curtain wall having a mullion structure in which mullions are fixed to a structural body of building, for example, such as concrete floor slab, steel framed truss or the like, transoms are stretched between adjacent mullions respectively, and an open-close type window or glass window is mounted to a space defined by the adjacent two mullions and the transoms stretched therebetween.

There is known as a curtain wall having a mullion structure, such as disclosed in Japanese Utility Model Publication No. HEI 2-33536, in which a plurality of transoms are connected between bilateral right and left mullions to define a space therebetween for mounting a window structure, and vertical frame members are attached between upper and lower transoms of the bilateral mullions to thereby form a rectangular frame by the upper and lower transoms and the bilateral vertical frame members. A sash is fitted to the frame thus formed to be opened and closed, constituting a sash unit.

According to the conventional curtain wall having the mullion structure mentioned above, the sash unit must be assembled at a construction site by connecting the transoms to the mullions, mounting the transoms to the vertical frames and fitting the sash to the frame thus formed, providing a troublesome assembling workings and being inconvenient.

SUMMARY OF THE INVENTION

An object of the present invention is to substantially eliminate the problem encountered in the prior art mentioned above and to provide a curtain wall having a mullion structure having an improved structure capable of substantially reducing troublesome assembling working at a construction site.

This and other objects can be achieved according to the present invention by providing a curtain wall having a mullion structure comprising:

bilateral mullions;

a sash unit to be mounted to the mullions, the sash unit comprising a sash unit frame and a sash mounted to the sash unit frame;

supporting members fixed to the mullions for supporting the sash unit frame; and a fixing member disposed for fixing one of bilateral side portions of the sash unit frame to one of the mullions, wherein the mullions are provided with recessed grooves, respectively, opened to a width direction of the sash in the mounted state, the sash unit frame has bilateral side portions to be fitted in the recessed grooves respectively by first inserting one side portion of the sash unit frame into corresponding one recessed groove formed of one mullion from an indoor side and then fitting under pressure the other one side portion thereof to the corresponding other recessed groove of the other mullion in a manner such that bilateral lower portions of the sash unit frame are rested on the supporting members respectively, in a mounted state of the sash unit frame, and either one of the side portions of the sash unit frame is then fixed to corresponding either one of the mullions by means of the fixing member.

The fixing member comprises a fixture fitting fixed to the mullion and provided with a groove opened upward and a pin fixed to the sash unit frame and adapted to be fitted to the groove of the fixture fitting, and such fixing member may be disposed at two portions for fixing one side portion of the sash unit frame to the mullion.

According to the curtain wall having the mullion structure described above, the sash unit frame can be fitted to the mullions by slidably inserting the frame into the recessed grooves formed to the mullions, and the fitted sash unit frame can be supported at its lower portions by the supporting members without falling down. Thereafter, one side portion, i.e. vertical frame member, of the sash unit frame is fixed to one of the mullion so as to prevent the sash unit frame from being shifted in the width and thickness direction thereof. Accordingly, the sash unit frame which has been preliminarily assembled in a work site, i.e. manufacturing place, can be assembled to the mullions, so that the assembling working of the sash unit at the construction site of the curtain wall can be substantially reduced, improving the assembling working of the curtain wall having a mullion structure.

Furthermore, since the sash unit frame and the mullion can be firmly fixed by fitting the pin fastened to the sash unit frame to the groove formed to a fixture fitting fixed to the mullion.

DESCRIPTION OF THE PREFERRED EMBODIMENTS

Figure 1:
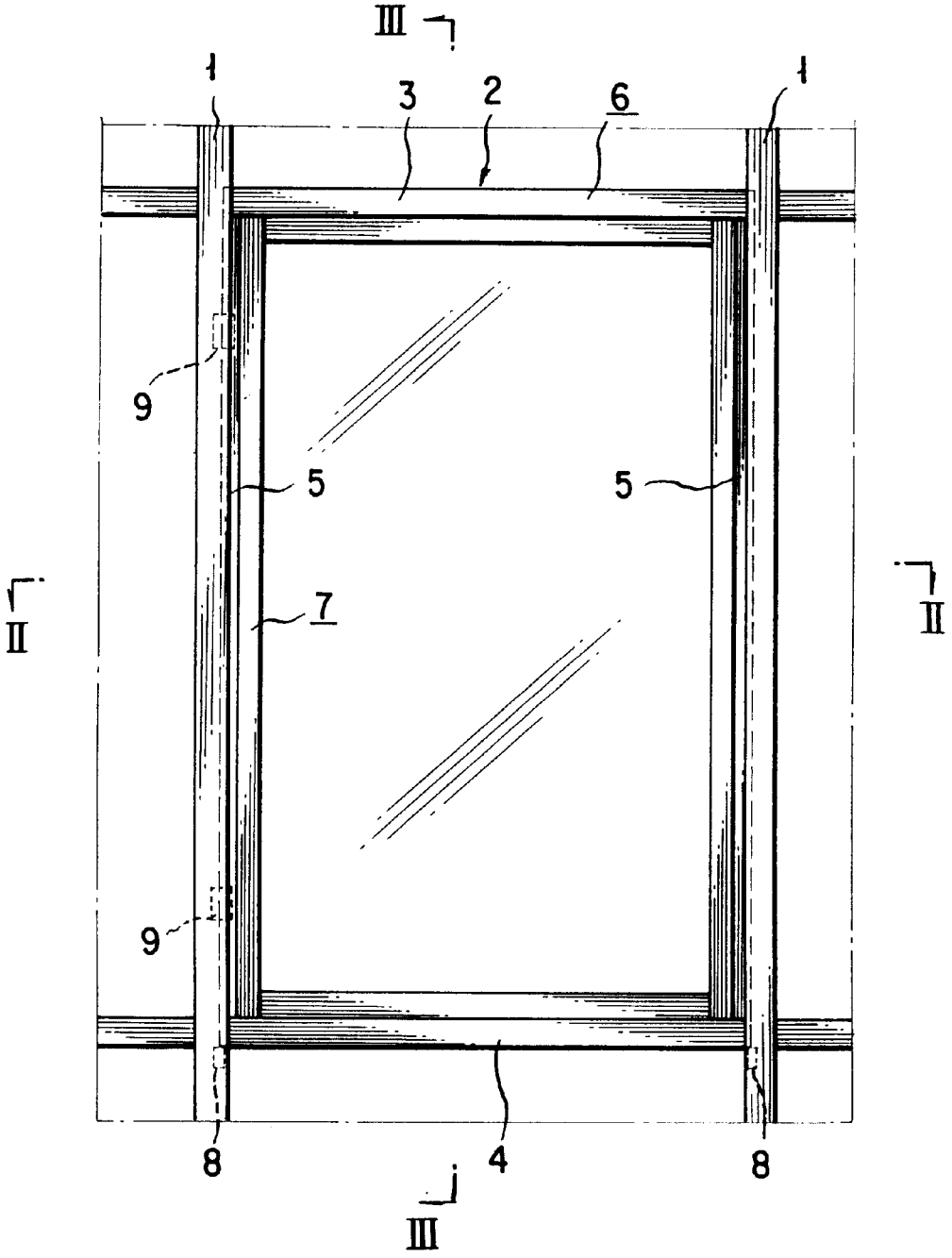
FIG. 1 is a schematic view showing an outer appearance of a sash unit attachment of a curtain wall having a mullion structure according to the present invention.

The present invention will be described hereunder with reference to a preferred embodiment shown in FIGS. 1 to 5, in which FIG. 1 is a front view of an entire outer appearance of a sash unit attachment to which the present invention is applied.

Figure 2:
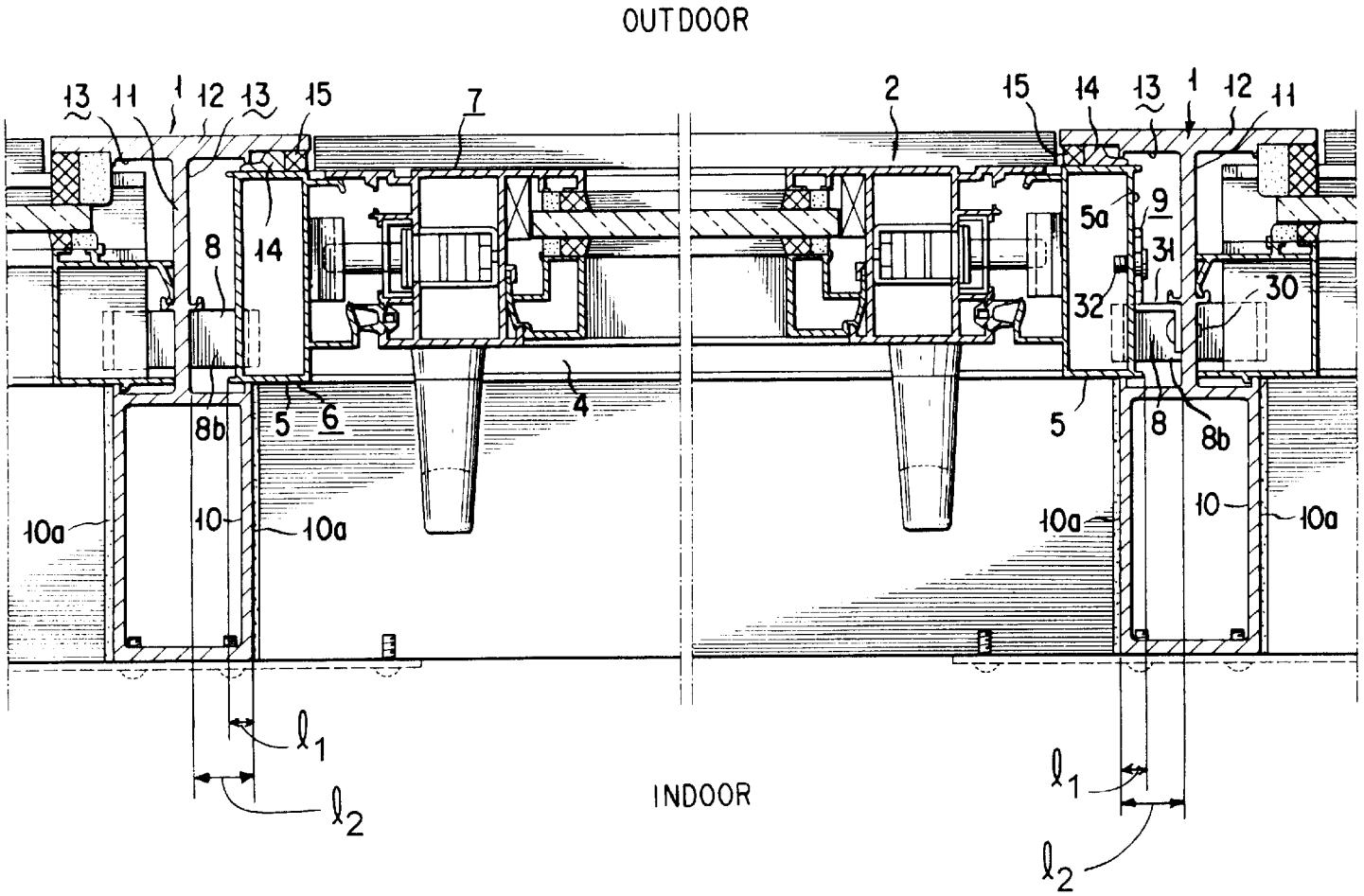
FIG. 2 is a cross sectional view taken along the line II—II in FIG. 1, including a fixing member.
Figure 3:
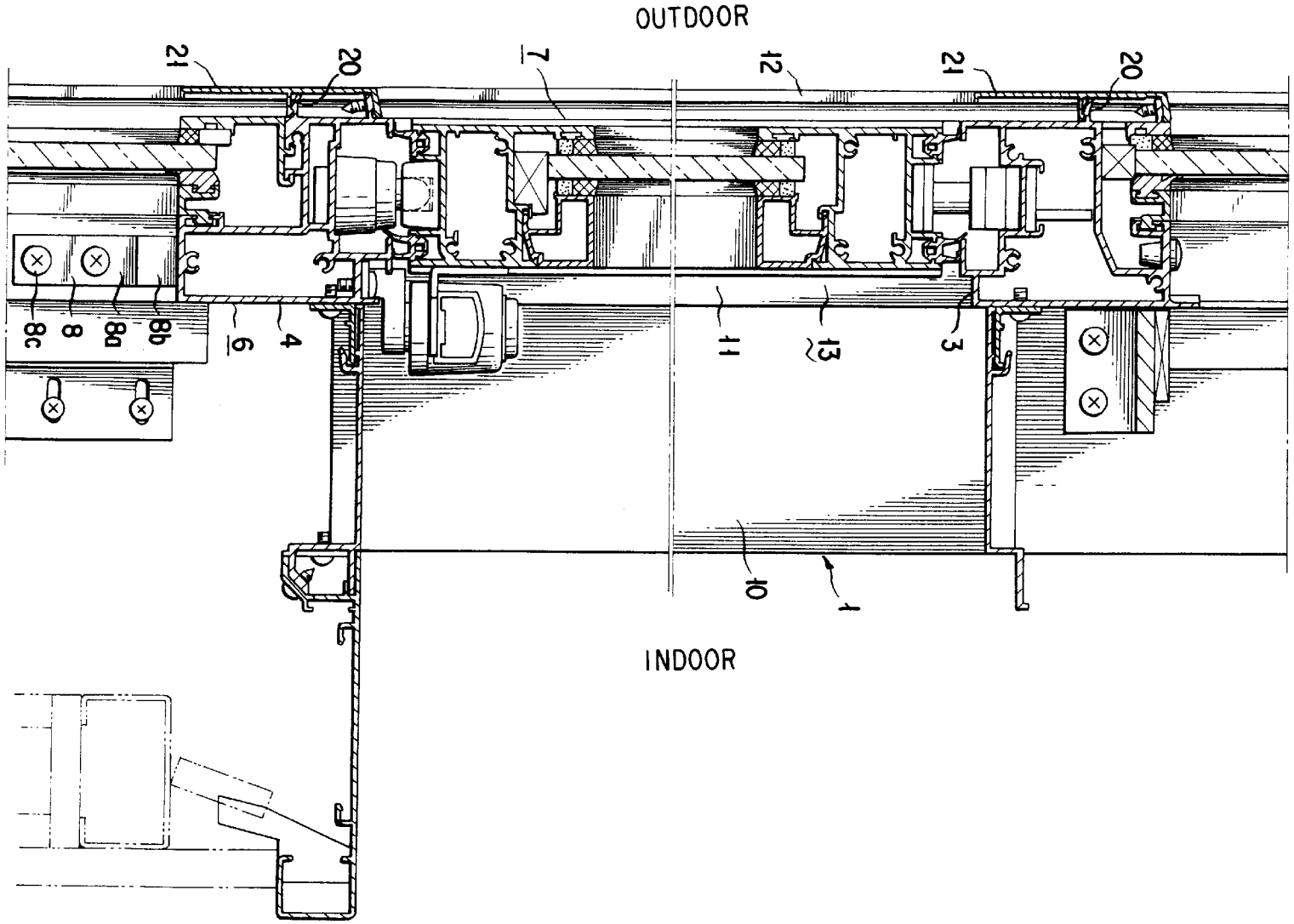
FIG. 3 is a longitudinal sectional view taken along the line III—III in FIG. 1.

Referring to FIGS. 1 to 3, a sash unit 2 is composed of an upper frame member 3, a lower frame member 4, bilateral vertical frame members 5, which are assembled into a rectangular sash unit frame 6, and a sash 7 mounted to the frame 6 to be capable of being opened and closed. The sash unit 2 of this structure is fitted between bilateral right and left mullions 1 constituting a curtain wall.

In the mounted state, bilateral lower portions of the sash unit frame 6, i.e. vertical frame members 5 thereof, are placed on lower portion supporting members 8 attached to the mullions 1 to prevent the sash unit frame 6 from falling down when mounted. The sash unit frame 6 is fixed to the mullions 1 so as not to be moved in width and thickness directions of the sash by attaching fixing members 9 at portions, as shown in FIG. 1, near the upper and lower end portions of one of mullions 1 and corresponding one of vertical frame members 5.

The mullion 1, as shown in FIG. 2, is composed of a hollow body 10, a projection plate 11 integrally formed with the hollow body 10 so as to project towards an outdoor side and a transverse plate 12 integrally provided for a distal end of the projection plate 11. According to this structure, recessed grooves 13 are defined on the outdoor side of the bilateral side surfaces so as to vertically extend along the longitudinal direction thereof.

The dimensions of the upper, lower and vertical frame members 3, 4 and 5, in the thickness direction of the sash 7, are each slightly smaller than an opening width of the recessed groove 13 so that the bilateral vertical frame members 5 are to be inserted into the recessed grooves 13 of the mullions 1 and spacers 14 serving as a back-up member are pressed to portions between the outdoor side surfaces of the vertical frame members 5 and the transverse plates 12 of the mullions 1, preventing the sash from shifting in the thickness direction thereof.

The hollow body 10 of the mullion 1 has bilateral side portions 10*a* having a distance therebetween smaller than the length of the transverse plate 12 in the width direction of the sash, that is, both ends of the transverse plate 12 projecting over the side portions 10*a* of the hollow body 10, and the recessed groove 13 has a shallow portion near the hollow body 10, i.e. in the indoor side direction and a deep portion near the transverse plate 12, i.e. in the outdoor side direction.

An insertion length of the indoor side of the recessed groove 13 of the sash unit frame 6 (minimum insertion length), i.e. a length overlapped of the side portion lO*a* of the body 10 and the vertical frame member 5, is made slightly smaller than a half of a depth of the recessed groove 13 at the indoor side portion.

According to such structure mentioned above, the sash unit frame 6 can be inserted into the recessed grooves 13 formed to the bilateral mullions 1 mounted to a building body by first inserting one side portion of the sash unit frame into the corresponding one recessed groove 13 of the one mullion 1 from the indoor side and then fitting under pressure the other one side portion thereof to the corresponding other recessed groove 13 of the other mullion. Furthermore, since the insertion length of the outdoor side of the recessed groove 13 of the sash unit frame 6 (maximum insertion length), i.e. the overlapped length of the outdoor side portion (outdoor side surface of the vertical frame member 5) of the sash unit frame 6 and the outdoor side portion of the recessed groove 13 (transverse plate 12) can be made large, whereby the spacers 14 and sealing members 15 can be surely disposed.

In this embodiment, engaging pieces 20 are integrally formed to the outdoor side surfaces of the upper frame member 3 and the lower frame member 4, respectively, and covers 21 are attached to these engaging pieces 20 so as to cover the same from the outside. The engaging pieces 20 are formed with cutout portions so as not to interfere with the transverse plates 12 of the mullions 1. The covers 21 are mounted to positions between the bilateral mullions 1 and the transverse plate 12 respectively, after attaching the sash unit frame 6.

Each of the lower portion supporting members 8 is composed of, as shown in FIGS. 2 and 3, a vertical piece 8*a* and a transverse piece 8*b* so as to provide a hook shape, the vertical pieces 8*a* being fixed to the projection plates 11 of the mullions 1 by means of small screws such as vises 8*c*, and the bilateral lower portions of the sash unit frame 6 are rested on the transverse piece 8*b*.

Figure 4:
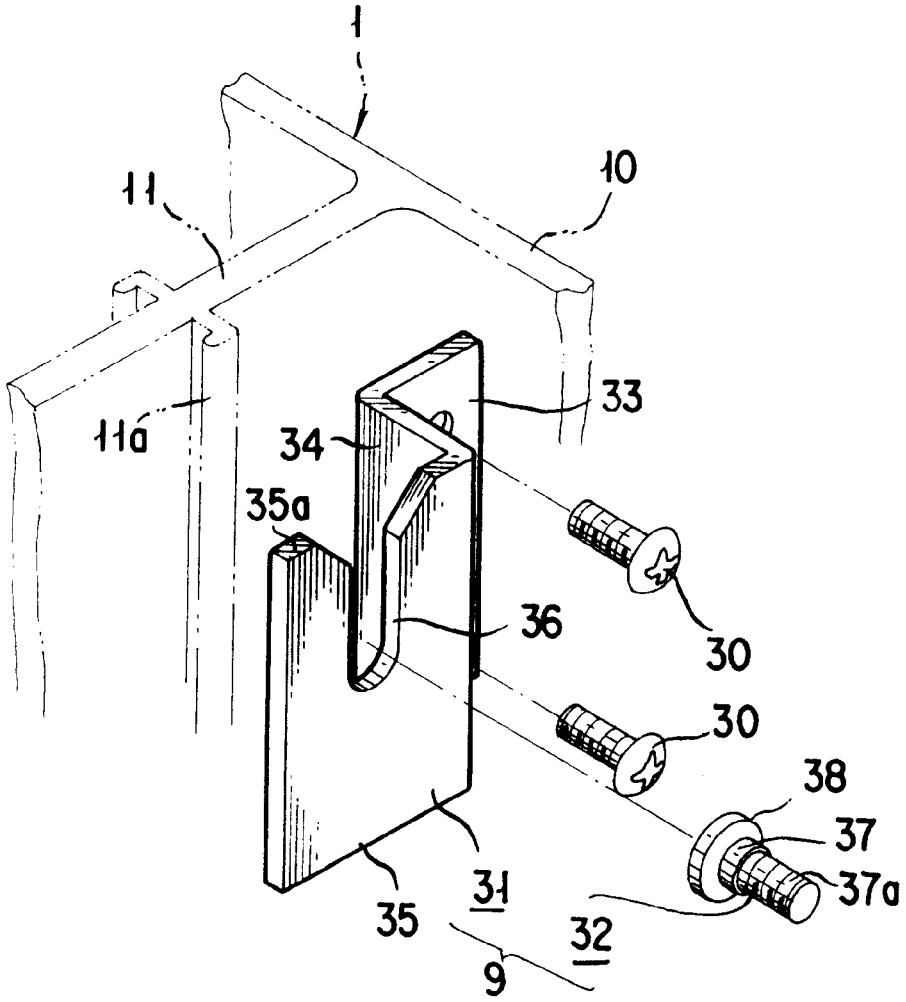
FIG. 4 is a perspective view showing disassembled state of a fixture and fixing pins.

Each of the fixing members 9 is composed of, as shown in FIG. 2, a fixture fitting 31 secured to the projection plate 11 of the mullion 1 by means of screws 30 and a pin 32 attached to the outer surface 5*a* of the vertical frame member 5. The fixture fitting 31 is composed of, as shown in FIG. 4, an attachment piece 33, a connection piece 34 and a fixing piece 35 so as to provide substantially a hook shape. A groove 36 is formed to the upper surface 35*a* of the fixing piece 35 so as to be opened upward in a mounted state, and the groove 36 has an upper end portion which is chamfered so as to provide a wide guide surface.

The attachment piece 33 is fixed to the projection plate 11 of the mullion by means of screws 30, and since an engagement piece 11*a* for attaching a bead is formed to the projection plate 11, the fixture fitting 31 can be surely positioned with respect to the thickness direction of the sash by abutting the attachment piece to the engaging piece 11*a*.

The pin 32 has a shank portion 37 having a diameter of a length equal to the width of the groove 36 and a flanged portion 38. The shank portion 37 is formed with a screw thread 37*a* which is screw engaged with the vertical frame member 5, and the shank portion 37 is fitted with the groove 36 of the fixture fitting 31 to firmly support the sash to prevent it from shifting in the sash width direction.

According to the structures mentioned above, the sash unit frame 6 is mounted to the recessed grooves 13 of the right and left mullions 1 by inserting both side portions of the sash unit frame 6, first one and then the other one side portion, into the recessed grooves 13 from the indoor side, respectively. Through this motion, the pins 32 are engaged with the grooves 36 of the fixture fittings 31 and the bilateral lower portions of the frame 6 are rested on the transverse pieces 8*b* of the lower portion supporting members 8, whereby the sash unit 2 can be surely mounted between the right and left mullions 1.

Figure 5:
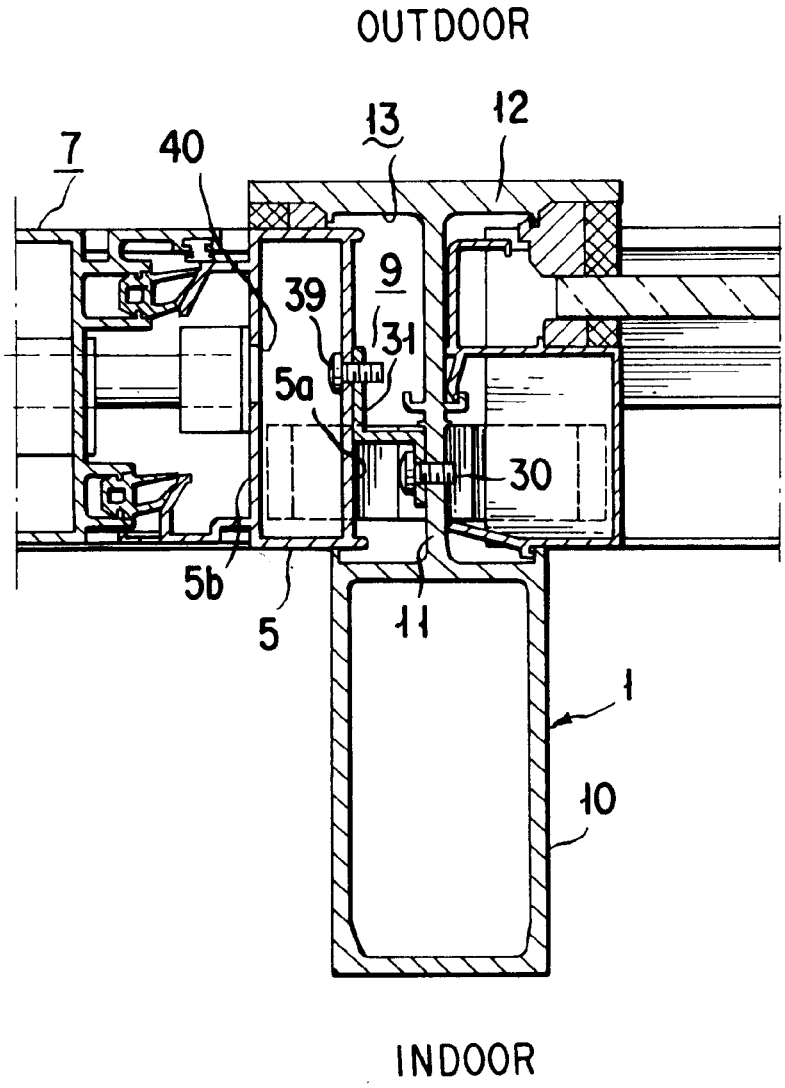
FIG. 5 is a cross sectional view of a fixing member of another example.

As shown in FIG. 5, the fixing member 9 may be composed of the fixture fitting 31 fixed to the projection plate 11 of the mullion 1 and a small screw such as screw 39 fixing the fixture fitting 31 to the outer surface 5*a* of the vertical frame member 5. In such a structure, the screw 39 will be engaged with a hole 40 formed to an inner surface of the vertical frame member 5.

It is of course possible to connect the curtain wall having the mullion structure mentioned above in plural numbers.

It is to be noted that the present invention is not limited to the described embodiment and many other changes and modifications may be made without departing from the scopes of the appended claims.

What is claimed is:

1. A curtain wall, comprising:

bilateral mullions extending in a substantially vertical direction parallel to each other, each of said mullions having a hollow body, a projection plate integrally formed with the hollow body and projecting towards an outdoor side, and a transverse plate integrally formed at an end portion of the projection plate;

a sash unit having a unit frame and a sash fitted to the unit frame, said unit frame having an upper frame member, a lower frame member, and a pair of vertical frame members connected to define a rectangular structure;

supporting members provided to said mullions and supporting said sash unit frame;

a fixing member fixing the sash unit frame to the mullions; and spacers disposed between an outdoor side portion of the vertical frame members and the transverse plate of the mullions, wherein each of said mullions has a recessed grove open to a width direction of the sash, said vertical frame members have a thickness narrower than an opening of the recessed groove so that each of the vertical frame members of the sash unit is fitted in said recessed groove of the mullions, and an insertion length of an indoor side of the vertical frame member in the recessed groove is smaller than a half of a depth of the indoor side portion of the recessed groove.

2. A curtain wall having a mullion structure according to claim 1, wherein said fixing member comprises a fixture fitting fixed to the mullion and provided with a groove opened upward and a pin fixed to the sash unit frame and fitted to the groove of the fixture fitting.

3. A curtain wall having a mullion structure according to claim 1, wherein two fixing members are disposed to one side portion of the sash unit frame.

* * * * *